US006245251B1

(12) United States Patent
Tomiyama

(10) Patent No.: US 6,245,251 B1
(45) **Date of Patent: *Jun. 12, 2001**

(54) METHOD FOR PRODUCTION OF SLIDE FASTENER OR STRINGERS THEREOF

(75) Inventor: Takashi Tomiyama, Kurobe (JP)

(73) Assignee: YKK Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/882,255

(22) Filed: Jun. 25, 1997

(30) Foreign Application Priority Data

Jun. 27, 1996 (JP) ..... 8-185374

(51) Int. Cl.[7] ..... C23F 1/00; B44C 1/22

(52) U.S. Cl. ..... 216/106; 252/79.4; 510/255; 134/3

(58) Field of Search ..... 216/106; 252/79.4; 134/3; 510/255

(56) References Cited

U.S. PATENT DOCUMENTS

| | | | | |
|---|---|---|---|---|
| 3,556,883 | | 1/1971 | Naito et al. | 216/107 |
| 4,040,863 | | 8/1977 | Kitamura | 134/3 |
| 4,859,281 | * | 8/1989 | Goltz | 216/106 |
| 4,880,495 | * | 11/1989 | Petraitis et al. | 216/106 |
| 5,030,373 | * | 7/1991 | Kimura et al. | 252/79.4 |
| 5,630,950 | * | 5/1997 | Cangelosi | 216/106 |

FOREIGN PATENT DOCUMENTS

| | | | | |
|---|---|---|---|---|
| 2847267 | | 5/1980 | (DE) . | |
| 28 47 267 | * | 5/1980 | (DK) | C23G/1/10 |
| 0387057 | | 9/1990 | (EP) . | |
| 49-93226 | | 9/1974 | (JP) . | |
| 49-98731 | | 9/1974 | (JP) . | |
| 49-104840 | | 10/1974 | (JP) . | |
| 8-24012 | | 1/1996 | (JP) . | |

OTHER PUBLICATIONS

Chemical Abstract, vol. 109, No.22, Nov. 1988, W. Han et al., Passivating Process for surface and Copper and it's alloy, abstract No. 195585u, p. 339.*

*Chemical Abstracts*, vol. 82, No. 14, Apr. 7, 1975, Yo Ito, Chemical polishing of copper and copper alloy, Abstract No. 89445n, p. 212.

*Chemical Abstracts*, vol. 82, No. 22, Jun. 2, 1975, Chemical polishing solution for copper and its alloys, Abstract No. 144015z, p. 262.

*Chemical Abstracts*, vol. 109, No. 22, Nov. 1988, W. Han et al., Passivating process for surface and copper and its alloys, Abstract No. 195585u, p. 339.

* cited by examiner

*Primary Examiner*—Randy Gulakowski
*Assistant Examiner*—Shamim Ahmed
(74) *Attorney, Agent, or Firm*—Finnegan, Henderson, Farabow, Garrett & Dunner, LLP

(57) ABSTRACT

Coupling elements of a slide fastener or stringer thereof manufactured by cutting and forming a multiplicity of coupling elements from a linear material of copper or a copper alloy and fixing the coupling elements as spaced with a prescribed interval to the longitudinal edge of a fastener tape are immersed in an acidic treating liquid containing hydrogen peroxide, sulfuric acid, phosphoric acid, a surfactant, and an aliphatic alcohol to effect acid treatment thereby smoothing the outer surfaces of the coupling elements. The acid-treated outer surfaces of the coupling elements of the slide fastener or stringer thereof may be further subjected to a rustproofing treatment. The rustproofed outer surfaces of the coupling elements may be further subjected to a clear coating treatment. The acid-treated outer surfaces of the coupling elements may be further plated.

11 Claims, 3 Drawing Sheets

METHOD FOR PRODUCTION OF SLIDE FASTENER OR STRINGERS THEREOF

BACKGROUND OF THE INVENTION

1. Field of the Invention

This invention relates to a method for the production of a slide fastener or stringers thereof having coupling elements made of copper or a copper alloy.

2. Description of the Prior Art

Heretofore, in the slide fastener or the stringers thereof having coupling elements made of copper or a copper alloy, the coupling elements made of copper or a copper alloy are generally formed by sequentially cutting a multiplicity of coupling element blanks 2' of a prescribed thickness from a linear material 1 made of copper or a copper alloy and possessed of a prescribed sectional shape conforming to the shape of coupling elements as illustrated in FIG. 1 and then imparting meshing or engaging depressions 3 and meshing or engaging projections 4 by the forming punch to the opposite faces of the coupling element blanks as illustrated in FIG. 2 and the coupling elements 2 thus cut and formed are sequentially fixed as spaced with a prescribed interval on the longitudinal edge of a fastener tape 5. As a result, such marks of cutting as undulating notches produced on outer faces 2*a* of the coupling elements 2 and burred parts produced on edge parts 2*b* thereof during the process of cutting the linear material 1 mentioned above persist on the coupling elements and compel the coupling elements to give an objectionable prickly touch. A slide fastener which is fabricated with these coupling elements 2 has the problem that a slider thereof is not smoothly moved when the two stringers thereof are mutually engaged or disengaged. Further, since the coupling elements are made of copper or a copper alloy, they have the problem that they offer no resistance to corrosion and easily yield their outer faces to oxidation and discoloration.

As means for improving the touch of the coupling elements or the ease of motion of the slider and as means for improving the resistance of the coupling elements to corrosion, the method of chemical polishing treatment which comprises chemically polishing the undulating parts on the outer faces of the coupling elements has been known. The chemical polishing treatment generally uses a chemical polishing liquid which contains hydrogen peroxide and sulfuric acid. It is implemented by wholly immersing in the chemical polishing liquid the slide fastener stringers having the coupling elements made of copper or a copper alloy fixed as spaced with a prescribed interval to the longitudinal edges of the fastener tapes. According to this chemical polishing treatment, an oxide is formed on the surfaces of the coupling elements made of copper or a copper alloy and the undulating cutting marks on the outer surfaces of the coupling elements are smoothly flattened when the oxide is dissolved by the acid.

Such mechanical means as punches and dies are used when the multiplicity of coupling element blanks are cut from the linear material of copper or a copper alloy and the meshing depressions and meshing projections are formed on the surfaces of the coupling element blanks with a forming punch. As an inevitable consequence, cutting oil and machine oil adhere to the outer surfaces of the coupling elements and they tend to impair the evenness of the chemical polishing. These coupling elements, therefore, must undergo a degreasing treatment with an aqueous alkali solution prior to the chemical polishing treatment. Since the chemical polishing liquid is an acidic liquid, the coupling elements which have undergone the degreasing treatment must be given a neutralizing treatment prior to the chemical polishing treatment. Further, when the coupling elements made of copper or a copper alloy are chemically polished with a treating liquid containing hydrogen peroxide, they require a step of washing with an acid (pickling step) for the removal of the skin of copper oxide (CuO) which is formed on the outer surfaces of the coupling elements.

When the slide fastener stringers having the coupling elements of copper or a copper alloy are subjected to the chemical polishing treatment, therefore, they need to be first degreased with an alkali, washed with water, neutralized (as with sulfuric acid), washed with water, chemically polished by immersion in the chemical polishing liquid, washed with water, further washed with acid (sulfuric acid), and washed with water. The chemical polishing treatment, therefore, is problematic in terms of cost because the number of component steps is so large as to boost the cost of materials and the cost of energy required for the steps. Further, the fact that the number of component steps is so large as mentioned above has entrained such problems as discoloring the fastener tapes dyed in advance and deteriorating the materials thereof.

Besides, the chemical polishing treatment by the use of the liquid containing hydrogen peroxide as mentioned above has the problem that the hydrogen peroxide during the treatment undergoes decomposition with evolution of bubbles and the produced bubbles adhere to the outer surfaces of the coupling elements and, as a result, disrupt the evenness of the chemical polishing.

SUMMARY OF THE INVENTION

An object of the present invention, therefore, is to eliminate the problems encountered by the prior art as mentioned above and provide a method which is capable of producing a slide fastener or stringers of the slide fastener having coupling elements made of copper or a copper alloy, which coupling elements excel in smoothness of outer surface and abounding in gloss, with a very few steps as compared with the conventional chemical polishing treatment and consequently with high productivity and low cost.

A further object of the present invention is to provide a method for the production of a slide fastener or stringers thereof which have coupling elements excelling in strength of attachment to the fastener tapes, resistance to corrosion, fastness to rubbing, fastness to laundering, and fastness to solvents and enjoying excellent touch and high gloss and which avoid discoloring the fastener tapes or deteriorating the material thereof.

Another object of the present invention is to provide a method which is capable of producing a slide fastener or stringers thereof excelling in resistance to corrosion, adhesion of a coating, and weatherability while enabling the rustproofing treatment and/or the coating treatment or the plating treatment as well as the treatment for smoothing the outer faces of coupling elements to be carried out rapidly in a series of steps.

In accordance with the fundamental embodiment of the present invention, to accomplish the objects mentioned above, there is provided a method for the production of a slide fastener or stringers thereof, which method comprises: providing a slide fastener or stringer thereof manufactured by cutting and forming a multiplicity of coupling elements from a linear material made of copper or a copper alloy and fixing the coupling elements as spaced with a prescribed interval to the longitudinal edge of a fastener tape; and then immersing the coupling elements of the slide fastener or stringer in an acidic treating liquid containing hydrogen peroxide, sulfuric acid, phosphoric acid, a surfactant, and an aliphatic alcohol to effect acid treatment thereby smoothing the outer surfaces of the coupling elements.

The method of the present invention may be applied appropriately to coupling elements made of copper or a copper alloy composed of 60–100% of Cu, 0–35% of Zn, 0–15% of Ni, and an inevitable impurity. As the acidic treating liquid mentioned above, an acidic aqueous solution containing 50–250 g/liter of hydrogen peroxide, 10–150 g/liter of sulfuric acid, 1–5 g/liter of phosphoric acid, 0.01–2 g/liter of a surfactant (surface-active agent), and 1–100 g/liter of an aliphatic alcohol may be used advantageously.

Further according to the present invention, for the purpose of improving the coupling elements of the slide fastener in such properties as resistance to corrosion, weatherability, and durability, the coupling elements of the slide fastener or the stringer thereof which have undergone the aforementioned acid treatment may be immersed in a rustproofing liquid to have the outer surfaces thereof further rustproofed and the rustproofed outer surfaces of the coupling elements may be further subjected to the application of a clear coating. The outer surfaces of the coupling elements which have undergone the acid treatment may be further subjected to a plating treatment.

BRIEF DESCRIPTION OF THE DRAWINGS

Other objects, features, and advantages of the invention will become apparent from the following description taken together with the drawings, in which.

DETAILED DESCRIPTION OF THE INVENTION

Figure 1:
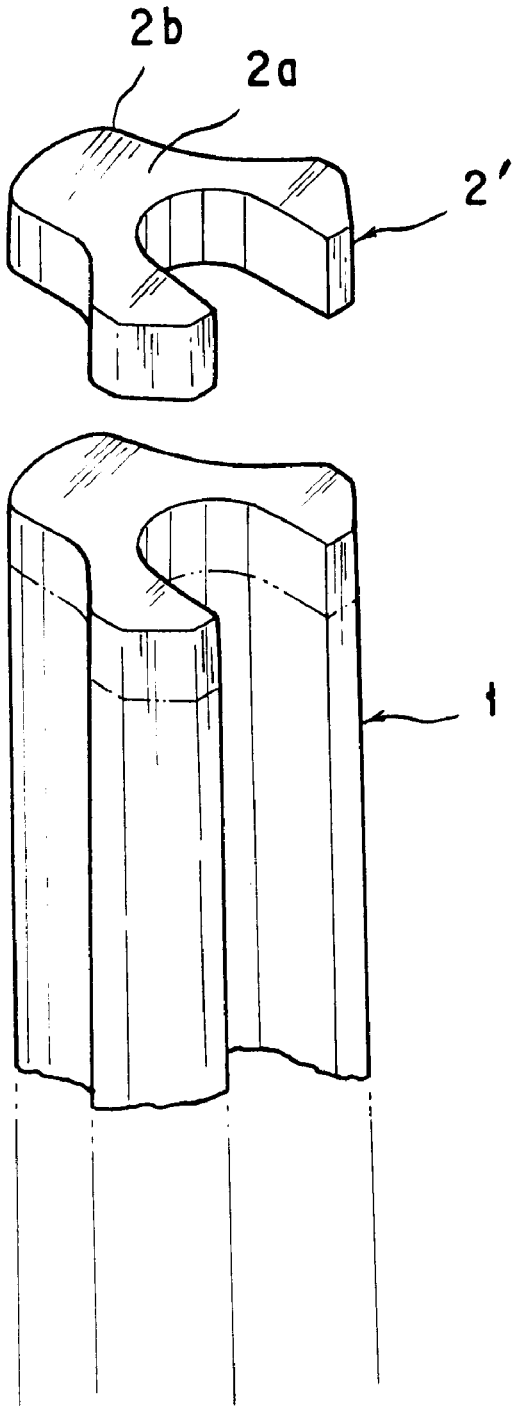
FIG. 1 (PRIOR ART)
FIG. 1 is a schematic partial perspective view illustrating a coupling element blank cut from a linear material made of copper or a copper alloy.
Figure 2:
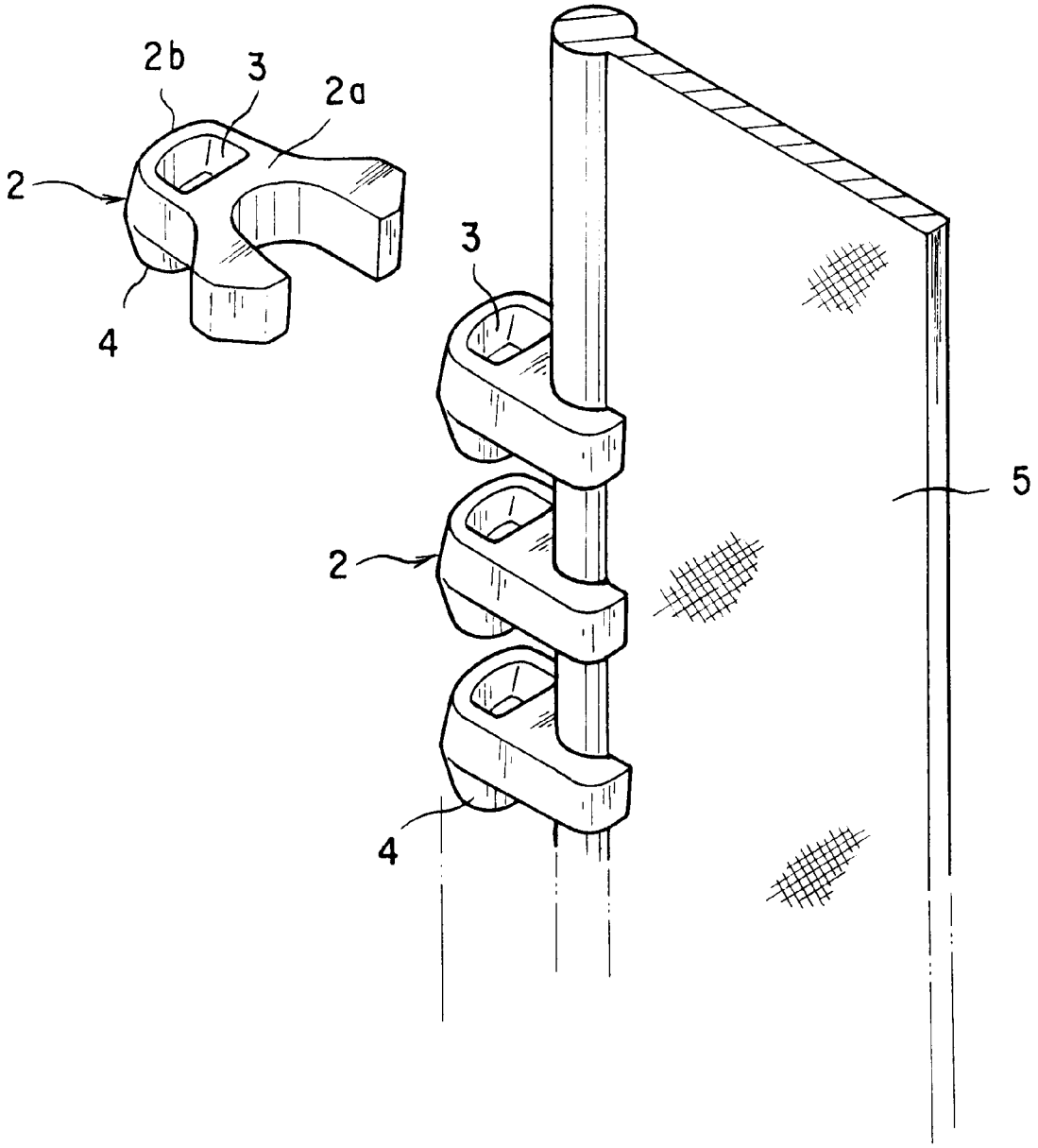
FIG. 2 (PRIOR ART)
FIG. 2 is a schematic partial perspective view illustrating the state in which coupling elements of copper or a copper alloy cut and formed from a linear material are fixed to the longitudinal edge of a fastener tape.

The method of the present invention for the production of a slide fastener or stringer thereof comprises providing a slide fastener or stringer thereof by cutting and forming a multiplicity of coupling elements from a linear material of copper or a copper alloy and fixing the coupling elements as spaced with a prescribed interval to the longitudinal edge of a fastener tape and then immersing the coupling elements of the slide fastener or stringer in an acidic treating liquid containing hydrogen peroxide, sulfuric acid, phosphoric acid, a surfactant, and an aliphatic alcohol thereby acid treating the outer surfaces of the coupling elements. Thus, this method of production is characterized by enabling the conventional process, i.e. the series of degreasing, neutralizing, chemically polishing, and pickling steps to be implemented solely by the aforementioned acid treatment.

Specifically, the present invention resides in providing a novel method for the treatment of coupling elements made of copper or a copper alloy and used on a slide fastener or stringers thereof, which method differs widely from the concept of the conventional chemical polishing treatment while adopting the principle of chemical polishing as follows in the smoothing treatment of the coupling elements made of copper or a copper alloy.

Now, the operation of the method of the present invention will be described in detail below.

First, the principle of smoothing the outer surfaces of the coupling elements made of copper or a copper alloy with hydrogen peroxide, sulfuric acid, and phosphoric acid will be explained.

The coupling elements made of copper or a copper alloy, on exposure to an oxidizing atmosphere, first form the oxide and the formed oxide dissolves in acid as represented by the following reaction formulas (1)–(3), which results in smoothing the surfaces of the coupling elements.

$$H_2O_2 \rightarrow H_2O + O \quad (1)$$

$$Cu + O \rightarrow CuO \quad (2)$$

$$CuO + H_2\ SO_4 CuSO_4 + H_2O \quad (3)$$

When a metal surface with a minute prickly undulation is immersed in a treating liquid, the reactions mentioned above form on the interface of the metal with the treating liquid a layer having diffused therein the copper oxide (oxide film) arising from the dissolution reaction and the metal dissolves as a salt into the treating liquid through the diffusion layer. The rate of diffusion at this stage is in reverse proportion to the thickness of the diffusion layer. On the assumption that the thickness of the diffusion layer is uniform relative to the apparent metal surface, the thickness is small on the projections and large on the depressions and conversely the rate of diffusion is high on the projections and low on the depressions, with the result that the metal surface will be smoothed.

Since the rate of dissolution of the oxide film by sulfuric acid is low, the rate of formation of the copper oxide by the reaction formulas (1) and (2) mentioned above and the rate of dissolution of the oxide film by the reaction formula (3) tend to be unbalanced. At this case, because of the presence of phosphoric acid capable of vigorously dissolving the oxide film, the reaction represented by the following reaction formula (4) arises and conspicuously promotes the reaction of dissolving the oxide film.

$$3CuO + 2H_3PO_4 \rightarrow Cu_3(PO_4)_2 + 3H_2O \quad (4)$$

When the dissolution reaction of the oxide film proceeds abruptly, however, the dissolution rate of the oxide film which is high on the projections and low on the depressions as mentioned above is not easily obtained and the projections and the depressions on the metal surface are inevitably dissolved at the same rate. The amount of phosphoric acid incorporated in the treating liquid, therefore, is limited below a certain level. When the concentration of sulfuric acid is increased in an effort to promote the reaction of the formula (3) mentioned above, the treatment fails to obtain a glossy surface of good smoothness. Generally the hydrogen peroxide-sulfuric acid-phosphoric acid type treating liquid, therefore, requires to keep the sulfuric acid concentration thereof at a low level. Incidentally, when the sulfuric acid concentration is low, since the reaction represented by the formula (3) mentioned above does not easily proceed and consequently the film of copper oxide (CuO) formed on the metal surface is not easily dissolved, the reaction of the formula (2) mentioned above proceeds with difficulty and the rate of polishing is retarded. Thus, it has been necessary that the metal surface after the treatment be immersed again in dilute sulfuric acid for pickling to dissolve and remove the film of copper oxide.

Further, in the case of the treating liquid of the hydrogen peroxide-sulfuric acid-phosphoric acid type, since the sulfuric acid concentration should be kept at a lower level as mentioned above, it is considered that the lower part of the oxide film (close to the metal surface) becomes sparingly susceptible of oxidation and dissolution and consequently the reaction fails to proceed easily not only in the direction of depth but also in the lateral direction in the projections. Particularly when grease adheres to the gaps between the projections, this grease functions as a barrier layer against the reactions mentioned above, with the result that the reaction of formation of the oxide film and the dissolution reaction thereof will be inhibited in the relevant parts. As a result, the parts of the surfaces of the coupling elements which are smeared with the grease either escape being polished or retard the rate of polishing, with the result that they will impair the evenness of surface smoothing and render difficult the formation of a glossy surface of good smoothness. As a result, it has been heretofore necessary that the coupling elements smeared with the grease be given a degreasing treatment capable of depriving their surfaces of the adhering grease.

In contrast, the acidic treating liquid to be used in the present invention contains a surfactant (surface-active agent) and an aliphatic alcohol besides hydrogen peroxide, sulfuric acid, and phosphoric acid.

The aliphatic alcohol has the function to promote the dissolution of the film of copper oxide in the liquid more rapidly on the projections than on the depression of the metal surface besides manifesting the effect in inhibiting the self-decomposition of hydrogen peroxide and stably retaining the composition of the liquid. The glossy surface with good smoothness, therefore, can be obtained even when the sulfuric acid concentration is heightened. Further, since the sulfuric acid concentration is allowed to increase, the reaction represented by the formula (3) mentioned above proceeds rapidly and the film of copper oxide dissolves in the liquid as soon as it forms and the dissolution reaction of copper oxide on the projections of the metal surface, as coupled with the reaction represented by the formula (4) mentioned above, proceeds rapidly. As a result, the reactions for the formation of the copper oxide represented by the formulas (1) and (2) mentioned above likewise proceed rapidly. Thus, the speed of smoothing the metal surface is conspicuously heightened and the treatment of the present invention does not need to be followed by an extra step of pickling.

Since the acidic treating liquid to be used in the present invention starts dissolving the oxide film as soon as the film forms on the metal surface, it is considered that the reactions mentioned above proceed rapidly not only in the direction of depth but also in the lateral direction in the projections. Even when the gaps between the projections are smeared with grease, therefore, it is considered that the polishing of the projections proceeds in concert with the floatation of the grease from the metal surface because the chemical polishing is additionally effected in the lateral direction of the projections. As a result, the adhesion of grease to the metal surface will not result in impairing the evenness of surface smoothing in the parts smeared with the grease. The presence of the surfactant is believed to function effectively to promote the separation of the grease from the metal surface.

As a result, the acid treatment is capable of imparting to the metal surface a glossy surface with good smoothness without requiring the metal surface to be given a degreasing treatment in advance.

When the coupling elements made of copper or a copper alloy are treated in the acidic treating liquid of the present invention as described above, the reaction rate of the chemical polishing is appreciably heightened and the decomposition of hydrogen peroxide which occurs at this time generates minute bubbles of oxygen and the bubbles adhere to the metal surface. If these bubbles are not promptly removed from the metal surface, the portions of the metal surface covered by the adhering bubbles escape being chemically polished and impair the evenness of surface smoothing (with the result that the metal surface will be coarsened).

Since the acidic treating liquid of the present invention contains the surfactant, however, this surfactant has the function to lower the surface tension of the treating liquid and permit abrupt removal of the bubbles adhering to the metal surface. The treatment, therefore, produces a glossy surface of high quality without impairing the evenness of surface smoothing.

When the coupling elements made of copper or a copper alloy are treated with the acidic treating liquid of the present invention as described above, since the functions of the components of the acidic treating liquid are manifested as exquisitely combined in an organic relation, the sole step of immersion in the acidic treating liquid suffices to smooth very rapidly the cutting marks inflicted on the outer surfaces of the coupling elements while the coupling element blanks are cut and formed from a linear material without requiring the conventional series of degreasing, neutralizing, and pickling steps. The treatment, therefore, proves extremely advantageous in terms of cost because it allows a slide fastener or stringers thereof having coupling elements excellent in touch and gloss to be manufactured with high productivity and, at the same time, permits a generous cut in the number of steps of process and a great decrease in the cost of material and the cost of energy necessary for the process.

Even when the coupling elements made of copper or a copper alloy which are already fixed as spaced with a prescribed interval to the longitudinal edge of a fastener tape are subjected to the acid treatment of the present invention, since this treatment is implemented very rapidly in a sole step as mentioned above, the possible discoloration of the fastener tape and the deterioration of the quality thereof are repressed to a great extent and the slide fastener after the treatment retains a high quality.

Since the acid treatment according to the present invention is attained solely by immersing the given object of treatment in the acidic treating liquid of the present invention and further since the number of steps of process is small, slide fastener stringers having coupling elements can be treated in their continued state and also slide fasteners having stringers of a prescribed length, when demanded by a client who needs to use slide fasteners, can be easily treated by a manual work as set in a suitable jig such as a hanger made of stainless steel. Thus, the acid treatment is at an advantage in being adaptable for the system of wide-variety small-quantity production.

When the coupling elements which have undergone the acid treatment of the present invention described above have their outer surfaces further subjected to a rustproofing, a clear coating, or a plating treatment, the ultimate products excel in resistance to corrosion, adhesion of a coat, weatherability, etc.

Since the slide fastener stringers which have the coupling elements made of copper or a copper alloy already fixed as spaced with a prescribed interval to the longitudinal edges of fastener tapes or the slide fasteners having the stringers are treated by the method of the present invention, the treating liquid does not easily reach the inner faces of the crotches of the coupling elements which embrace the edges of the fastener tapes. Since the inner faces of the crotches of the coupling elements are sparingly chemically polished, the possibility that the strength of attachment of the coupling elements to the fastener tapes will be lowered is nil.

Now, the component steps of process of the present invention will be described in detail below.

First, the step of acid treatment according to the present invention resides in immersing slide fastener stringers or slide fasteners having coupling elements made of copper or a copper alloy in the acidic treating liquid thereby rapidly smoothing the outer surfaces of the coupling elements by oxidation and dissolution and, at the same time, removing the cutting oil and the machine oil adhering to the outer surfaces of the coupling elements. Thus, this step simultaneously performs the degreasing, chemically polishing, and pickling steps of the conventional chemical polishing treatment. The treating time is generally proper in the range of 10 seconds to 3 minutes and the treating temperature is not higher than 50° C. If the temperature exceeds 50° C., the hydrogen peroxide will be easily decomposed.

As the acidic treating liquid, the acidic aqueous solution containing hydrogen peroxide, sulfuric acid, phosphoric acid, a surfactant, and an aliphatic alcohol is used as mentioned above. Properly, the concentration of hydrogen peroxide is in the range of 50–250 g/liter, that of sulfuric acid in the range of 10–150 g/liter, that of phosphoric acid in the range of 1–5 g/liter, that of the surfactant in the range of 0.01–2 g/liter, and that of the aliphatic alcohol in the range of 1–100 g/liter. These concentrations of the components of the acidic treating liquid have been selected in consideration of such factors as the susceptibility of the outer surfaces of the coupling elements to the smoothing treatment, the discoloration of the fastener tapes, and the deterioration of the quality thereof.

As concrete examples of the surfactant, anionic surfactants such as higher alcohol sulfuric ester salts, alkylbenzene sulfonates, alkylnaphthalene sulfonates, formalin-condensed naphthalene sulfonates, dialkyl sulfosuccinates, alkylphosphates, and polyoxyethylene sulfates; cationic surfactants such as alkyl amine salts and polyoxyethylene alkyl amines; nonionic surfactants such as polyoxyethylene alkyl ethers, polyoxyethylene alkylaryl ethers, polyoxyethylene polyoxypropylene ethers, sorbitan fatty acid esters, polyoxyethylene fatty acid esters, fatty acid polyoxyethylene amides, and fatty acid ethanol amides; and ampholytic surfactants such as alkyl betaine may be cited. Among other surfactants mentioned above, polyoxyethylene oleyl ether, sodium butyl naphthalene sulfonate, polyoxyethylene polyoxypropylene ether, and polyoxyethylene stearyl amine prove to be particularly favorable.

As concrete examples of the aliphatic alcohol which is used favorably herein, lower aliphatic alcohols or polyhydric alcohols of not more than five carbon atoms such as methyl alcohol, ethyl alcohol, ethylene glycol, and propylene glycol may be cited.

As the coupling elements made of copper or a copper alloy to be treated by the method of the present invention, while those made of copper or a copper alloy having the composition mentioned above are invariably usable herein, those made of brass composed of 65–100% of Cu, 0–35% of Zn, and inevitable impurities and those of German silver composed of 60–70% of Cu, 20–25% of Zn, 10–15% of Ni, and inevitable impurities are favorably usable.

As the fastener tapes to which the coupling elements made of copper or a copper alloy are fixed, the tapes manufactured by weaving or knitting fibers of various materials such as polyester, cotton, acetate, nylon, and polyester/cotton mixture (textile blend) can be used. Among other tapes mentioned above, those of polyester or polyester/cotton mixture which manifest resistance to acidic liquids prove to be particularly advantageous because they hardly succumb to discoloration or deterioration of quality when they undergo the treatment of the present invention.

The fastener tapes made of cotton are possibly discolored, depending on the kind of a dye to be used. The dye to be used, therefore, must be selected attentively.

After the acid treatment mentioned above, the fastener stringers are subjected to the step of washing with water for the purpose of removing the acidic treating liquid adhering thereto.

For the purpose of properly performing the washing with water, the fastener stringers which have undergone the acid treatment are first deprived of the acidic treating liquid adhering thereto by the method of vacuum dehydration so as to decrease to the fullest possible extent the amount of the acidic treating liquid suffered to enter the washing bath. The step of washing with water which is performed after the vacuum dehydration mentioned above can be rapidly and effectively carried out by the cyclic washing of spray washing, dehydration, rinsing by immersion, and dehydration. Some other method of washing by immersion may be adopted instead.

In the following description, the expression "step of washing with water" will be used in the sense of embracing both the vacuum dehydration and the washing with water.

Further according to the present invention, the coupling elements of the slide fastener stringers which have undergone the step of acid treatment and the step of washing with water may be further subjected to the rustproofing treatment (step of rustproofing+step of washing with water+step of drying) or further to the treatment of clear coating (step of coating+step of drying) or the plating treatment to improve the resistance to corrosion, weatherability, etc. thereof.

The rustproofing step is a step for preventing the surfaces of the coupling elements already smoothed by the acid treatment mentioned above from forming an oxide again or for improving the adhesiveness of a coat to be produced during the step of clear coating. If the acidic treating liquid remains in the meshing depressions of the coupling elements, it will be concentrated by drying and suffered to impair the fastness of adhesion of a coat to the surfaces of the coupling elements. Where the clear coating is performed at all, the coupling elements are preferred to undergo the rustproofing treatment in advance of the coating treatment.

This rustproofing step is performed by immersing the coupling elements in or spraying them with a benzotriazole type aqueous solution, a phosphoric ester type aqueous solution, or other rustproofing liquid heretofore known to the art. For the purpose of imparting improved wettability to the coupling elements, the rustproofing liquid may additionally incorporate therein such a surfactant as mentioned above. Properly, the concentration of the rustproofing agent in the rustproofing liquid is in the range of 0.1–5% by weight. If this concentration is unduly high, the white powder of the rustproofing agent will possibly remain in the gaps between the fibers of the tapes and impair the appearance of the tapes. When the rustproofing treatment is carried out by the method of immersion, the temperature of treatment is properly not higher than 50° C., preferably near room temperature, and the duration of treatment is in the approximate range of 10 seconds to one minute.

The rustproofing step is not necessary when the plating treatment or some other similar treatment is immediately carried out at the next step. It may be omitted when the oxide formed only slightly does not matter for the sake of the subsequent step. The plating treatment can be carried out by any of various methods heretofore known to the art.

The step of washing with water after the rustproofing step may be omitted when the rustproofing agent has no adverse effect on the fastener tapes.

The drying step is preferred to be carried out at a temperature not exceeding 150° C., the highest level at which the dyefastness of the fastener tapes is not adversely affected, by the use of hot air or some other heat source.

The clear coating step is carried out by applying a clear coating material with a roll coater or any other means exclusively to the coupling elements of copper or a copper alloy on the fastener stringers. This treatment is capable of improving the coupling elements in resistance to corrosion.

The step of drying the coat is carried out in the same manner as the drying step which is performed subsequently to the rustproofing step mentioned above.

Since the series of corrosion proofing treatments, i.e. the rustproofing treatment and the clear coating, are immediately performed on the coupling elements of copper or a copper alloy to which the acid treatment of the present invention has imparted a highly glossy surface resembling a mirror, a coat rich in adhesiveness is formed on the surfaces of the coupling elements and harnessed to improve the coupling elements conspicuously in resistance to corrosion and, at the same time, confer on the coupling elements such fastness to rubbing as is necessary for a slide fastener.

As the final step, the coupling elements may be waxed for the purpose of allaying the resistance thereof to sliding as is usually performed on standard slide fasteners. This step may be omitted when the resistance to sliding is amply slight.

The series of steps mentioned above are such that each of them may be severally performed batchwise or they may be grouped arbitrarily and performed continuously. Even when the first through last steps are continuously performed, the product acquires the same quality.

Now, the present invention will be described more specifically below with reference to working examples.

EXAMPLE 1

A fastener stringer having coupling elements of a copper alloy composed of 85% of Cu and 15% of Zn was given an acid treatment by immersion in an acidic treating liquid kept at 30° C. for two minutes.

As the acidic treating liquid, an acidic aqueous solution containing 1 g/liter of polyoxyethylene oleyl ether as a surfactant, 80 g/liter of hydrogen peroxide, 20 g/liter of sulfuric acid, 0.5 g/liter of phosphoric acid, and 20 g/liter of methyl alcohol was used.

Then, the acidic treating liquid contained consequently in the fastener tape was removed by vacuum dehydration for the purpose of facilitating the washing with water at the next step.

Subsequently as the step of washing with water, the fastener stringer was vigorously sprayed with water, subjected immediately to vacuum dehydration, immersed in water, and subjected at once to vacuum dehydration.

For the purpose of thoroughly removing the acidic treating liquid contained in the fastener tape, the aforementioned step of washing with water consisting of spraying, dehydration, immersion, and dehydration was repeated three times.

Figure 3A:
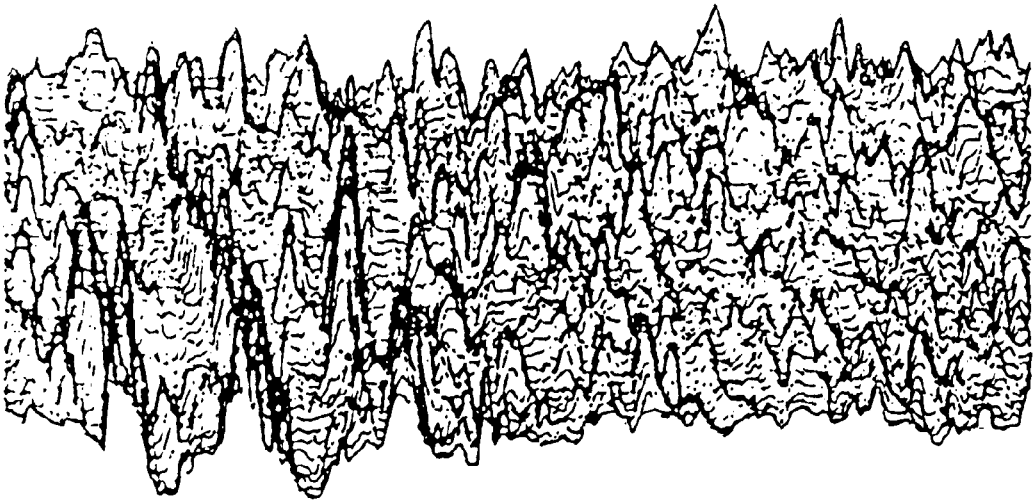
FIG. 3A and FIG. 3B are magnified diagrams of the surface conditions of a coupling element determined by a scanning laser microscope respectively before and after the acid treatment according to the present invention.
Figure 3B:
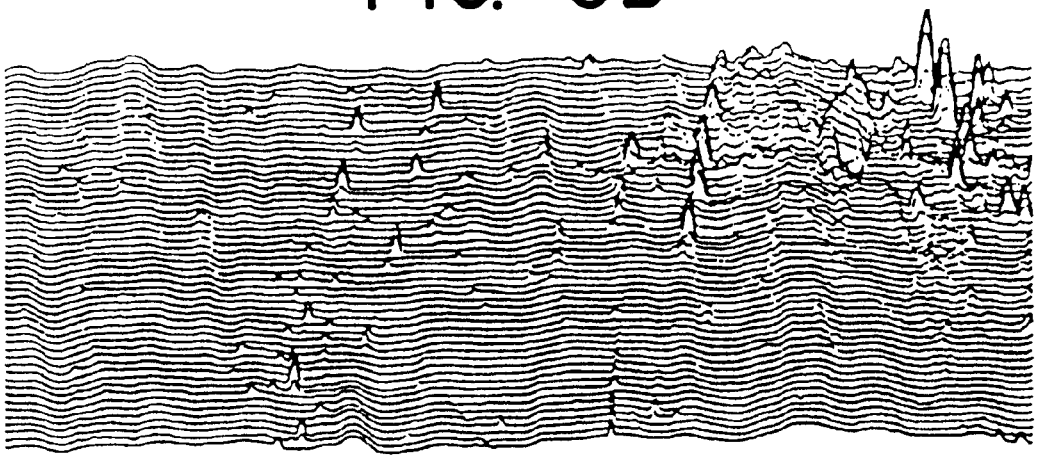

The coupling elements on the product obtained in Example 1 and those on the fastener stringer before the treatment were tested for surface condition with a scanning laser microscope produced by Laser Tech K. K. and marketed under product code of "1 LM-21". The test was made on the surfaces of the coupling elements in a fixed area, 0.7 mm in length and 0.1 mm in width. Bird's-eye views produced by magnifying the relevant areas 100 times in the direction of length, 250 times in the direction of width, and 2,500 times in the direction of height are shown in FIGS. 3A and 3B. FIG. 3A represents the surface condition before the treatment and FIG. 3B that after the treatment.

With respect to the fastener stringers before and after the acid treatment of the present invention, the distributions of undulating depths on the surfaces of the coupling elements were determined by calculation based on the results of the test mentioned above. The maximums and the averages of the undulating depths on the surfaces of the coupling elements determined on the basis of the results mentioned above are shown in Table 1.

TABLE 1

| Fastener | Depth of undulation(μm) Average | Maximum |
|---|---|---|
| Before acid treatment | 5.04 | 7.46 |
| After acid treatment | 1.67 | 2.45 |

The coupling elements of the fastener stringers could not be tested for glossiness because they were extremely small, i.e. 1 mm in width and 3 mm in length. As an alternative, a plate of the copper alloy composed of 85% of Cu and 15% of Zn was subjected to the acid treatment of Example 1 and it was tested for glossiness before and after the acid treatment.

The test for glossiness was performed by determining a 20-degree specular gloss with a gloss meter produced by Murakami Shikisai Gijutsu Kenkyosho and marketed under product code of "GM-26D" in accordance with JIS (Japanese industrial standards) Z-8741 with necessary modifications. The increase in glossiness was found by calculating the difference of glossiness before and after the acid treatment. The results are shown in Table 2.

TABLE 2

| Item | Before acid treatment | After acid treatment | Increase of glossiness |
|---|---|---|---|
| Glossiness | 337 | 1089 | 752 |

EXAMPLE 2

A fastener stringer having coupling elements of a copper alloy composed of 85% of Cu and 15% of Zn was given an acid treatment by immersion in an acidic treating liquid kept at 30° C. for two minutes and then washed with water in the same manner as in Example 1. The acidic treating liquid used herein was the same as that used in Example 1. The step of washing with water was performed in the same manner as in Example 1.

Next, the acid treated fastener stringer was rustproofed by immersion in an aqueous solution containing 1 g/liter of 1,1,1-benzotriazole at room temperature for 30 seconds.

Then, the rustproofed fastener stringer was dehydrated, placed in a drying device, and dried therein by being blown with hot air of 130° C. for three minutes.

Subsequently, an acryl-urethane type clear coating material was applied with a roll to the obverse surfaces of the coupling elements on the fastener stringer and the applied layer of the coating material was dried with hot air at 110° C. for 10 minutes to effect clear coating. The reverse surface of the fastener stringer was similarly subjected to clear coating and the surfaces of the coupling elements were waxed to complete a product.

The coupling elements of the product of Example 2 were tested for various corrosionproof properties shown in Table 3. The results are shown in Table 3. The numerical values shown in Table 3 represent the ratios (%) of an area sustaining corrosion to the total area of the surfaces of the coupling elements. The test for fastness to acidic perspiration and the test for fastness to alkaline perspiration were carried out in accordance with JIS-L-0848 (A process), the salt spray test in accordance with JIS-H-8610, the test for lightfastness in accordance with JIS-L-0841, and the test for weatherability in accordance with JIS-D-0205. The sulfur dioxide gas exposure test was carried out by placing in a desiccator a beaker containing 10 ml of an aqueous 35% sodium hydrogen sulfite solution and suspending a sample in the desiccator with a hanger. The ammonia gas exposure test was carried out by placing in a desiccator a beaker containing 10 ml of an aqueous 28% ammonia solution and suspending a sample in the desiccator with a hanger.

TABLE 3

| Item of test | | Object of test: Product treated by Example 2 | Object of test: Untreated product |
|---|---|---|---|
| Test for fastness to acidic perspiration | | 0 | 100 |
| Test for fastness to alkaline perspiration | | 0 | 80 |
| Salt spray test | 24 hr | 0 | 100 |
| Test for lightfastness | 20 hr | 0 | 40 |
| Test for weatherability | 24 hr | 0 | 20 |
| | 100 hr | 0 | 100 |
| | 250 hr | 10 | 100 |
| Sulfur dioxide gas exposure test | 24 hr | 0 | 20 |
| | 168 hr | 20 | 80 |
| Ammonia gas exposure test | 24 hr | 20 | 100 |
| | 168 hr | 80 | 100 |

While certain specific working examples have been disclosed herein, the invention may be embodied in other specific forms without departing from the spirit or essential characteristics thereof. The described examples are therefore to be considered in all respects as illustrative and not restrictive, the scope of the invention being indicated by the appended claims rather than by the foregoing description and all changes which come within the meaning and range of equivalency of the claims are, therefore, intended to be embraced therein.

I claim:

1. A method for the production of a slide fastener or stringer thereof, comprising:

providing a slide fastener or stringer thereof manufactured by cutting and forming a multiplicity of coupling elements from a linear material made of copper or a copper alloy, said coupling elements having cutting marks caused by cutting work, and fixing said coupling elements as spaced with a prescribed interval to a longitudinal edge of a fastener tape; and without prior degreasing, immersing the coupling elements of the slide fastener or stringer in an acidic treating liquid consisting essentially of hydrogen peroxide, sulfuric acid, phosphoric acid, a surfactant, and an aliphatic alcohol having 1 to 5 carbon atoms to effect acid treatment thereby smoothing outer surfaces of the coupling elements.

2. The method according to claim 1, further comprising subjecting said acid treated slide fastener or stringer to vacuum dehydration and washing with water.

3. The method according to claim 1, further comprising immersing said acid treated coupling elements of said slide fastener or stringer thereof in a rustproofing liquid to effect a rustproofing treatment on the outer surfaces of said coupling elements.

4. The method according to claim 3, wherein said rustproofed outer surfaces of said coupling elements are further subjected to clear coating.

5. The method according to claim 1, further comprising subjecting said acid treated outer surfaces of said coupling elements to plating.

6. The method according to claim 1, wherein said coupling elements are made of copper or a copper alloy composed of 60–100% of Cu, 0–35% of Zn, 0–15% of Ni, and an inevitable impurity.

7. The method according to claim 1, wherein said coupling elements are made of copper or a copper alloy composed of 65–100% of Cu, 0–35% of Zn and an inevitable impurity.

8. The method according to claim 1, wherein said coupling elements are made of a copper alloy composed of 60–70% of Cu, 20–25% of Zn, 10–15% of Ni, and an inevitable impurity.

9. The method according to claim 1, wherein said acidic treating liquid is formed of an acidic aqueous solution containing 50–250 g/liter of hydrogen peroxide, 10–150 g/liter of sulfuric acid, 1–5 g/liter of phosphoric acid, 0.01–2 g/liter of a surfactant, and 1–100 g/liter of an aliphatic alcohol.

10. The method according to claim 1, wherein said acid treatment is carried out at a temperature of not more than 50° C. for a period in the range of 10 seconds to 3 minutes.

11. The method according to claim 1, wherein said aliphatic alcohol is a monovalent or polyvalent alcohol having 1 to 5 carbon atoms.

* * * * *